US008616408B2

(12) United States Patent
Saarvali et al.

(10) Patent No.: US 8,616,408 B2
(45) Date of Patent: Dec. 31, 2013

(54) PAPER TOWEL DISPENSER

(75) Inventors: Eva-Li Saarvali, Vastra Frolunda (SE); Mikael Linden, Gothenburg (SE); Anders Aberg, Molnlycke (SE)

(73) Assignee: SCA Hygiene Products AB, Gothenburg (SE)

( * ) Notice: Subject to any disclaimer, the term of this patent is extended or adjusted under 35 U.S.C. 154(b) by 391 days.

(21) Appl. No.: 12/936,912

(22) PCT Filed: Apr. 10, 2008

(86) PCT No.: PCT/SE2008/050409

§ 371 (c)(1), (2), (4) Date: Oct. 8, 2010

(87) PCT Pub. No.: WO2009/126077

PCT Pub. Date: Oct. 15, 2009

(65) Prior Publication Data

US 2011/0031265 A1 Feb. 10, 2011

(51) Int. Cl.

| | |
|---|---|
| ***B65H 1/00*** | (2006.01) |
| ***A47K 10/24*** | (2006.01) |
| ***B65H 35/10*** | (2006.01) |
| ***B26F 3/02*** | (2006.01) |

(52) U.S. Cl.

USPC ..... 221/48; 221/22; 221/25; 221/70; 221/305; 221/34; 221/2; 221/45; 221/12; 225/46; 225/88; 225/80; 225/53; 206/44.12

(58) Field of Classification Search

CPC ..... B65H 1/00; B65H 35/10; A47K 10/24; B26F 3/02

USPC ..... 221/48, 22, 25, 70, 305, 34, 2, 45; 222/12, 2; 206/44.12; 225/46, 88, 80, 225/53

See application file for complete search history.

(56) References Cited

U.S. PATENT DOCUMENTS

| | | | | | |
|---|---|---|---|---|---|
| 1,088,389 | A | * | 2/1914 | Wheeler | 221/48 |
| 1,122,108 | A | * | 12/1914 | Hamilton | 221/47 |
| RE21,678 | E | * | 12/1940 | Daykin | 225/46 |
| 2,426,787 | A | | 9/1947 | O'Neil | |

(Continued)

FOREIGN PATENT DOCUMENTS

| | | | |
|---|---|---|---|
| GB | 1914 03090 | A | 5/1914 |
| GB | 1914 20512 | A | 3/1915 |

OTHER PUBLICATIONS

International Search Report, dated Dec. 19, 2008, from corresponding PCT application.

*Primary Examiner* — Gene O. Crawford
*Assistant Examiner* — Rakesh Kumar
(74) *Attorney, Agent, or Firm* — Drinker Biddle & Reath LLP

(57) ABSTRACT

A paper towel dispenser includes a housing for holding a stack of interfolded towels. The housing includes a front wall, a rear wall, two outer side walls, an upper wall and a support surface for the stack of towels, the stack of towels being located adjacent and parallel to at least the front wall. The front wall extends a predetermined distance below the support surface. A dispensing opening is located between the front wall and the support surface, and at least one guide element is arranged to support a leading panel of a first towel adjacent the front wall and a leading edge of the leading panel parallel to the lower edge of the front wall.

12 Claims, 7 Drawing Sheets

(56) References Cited

U.S. PATENT DOCUMENTS

| | | | | | |
|---|---|---|---|---|---|
| 3,341,067 | A | | 9/1967 | Bastian | |
| 3,450,308 | A | | 6/1969 | Schoenefeld | |
| 4,811,878 | A | | 3/1989 | Horinchi | |
| 4,915,257 | A | * | 4/1990 | Bailey | 221/48 |
| 5,065,895 | A | * | 11/1991 | De Luca et al. | 221/54 |
| 5,219,082 | A | * | 6/1993 | Daugherty et al. | 213/75 R |
| 5,219,092 | A | * | 6/1993 | Morand | 221/53 |
| 5,447,253 | A | * | 9/1995 | Williams | 221/92 |
| 5,950,863 | A | * | 9/1999 | Schutz et al. | 221/46 |
| 5,957,324 | A | * | 9/1999 | Gettelman et al. | 221/55 |
| 6,334,544 | B1 | * | 1/2002 | Christensen et al. | 221/63 |
| 7,848,515 | B2 | * | 12/2010 | Dupaquis et al. | 380/28 |
| 8,136,697 | B2 | * | 3/2012 | Hackney | 221/305 |
| 2004/0124206 | A1 | * | 7/2004 | Tramontina et al. | 221/303 |
| 2009/0001212 | A1 | * | 1/2009 | Budz et al. | 242/563 |

* cited by examiner

PAPER TOWEL DISPENSER

TECHNICAL FIELD

The invention relates to a paper towel dispenser for dispensing individual towels from a stack of interfolded towels, which dispenser comprises at least one guide means is arranged to support a leading panel of a first towel adjacent a front wall and present a leading edge of said leading panel parallel to the lower edge of the front wall.

BACKGROUND ART

A wide variety of vertically positioned or upright towel and napkin dispensers are known from the prior art. A typical dispenser for a stack of towels is disclosed in U.S. Pat. No. 6,334,544. A problem with this dispenser is that when a first towel is withdrawn from the dispenser, the subsequent towel may be presented in a manner that makes it difficult to grip as the restricted opening causes the towel to bunch up. A further problem is that the subsequent towel may not be properly withdrawn, requiring the user to feel for the towel underneath the dispenser and possibly to extend his/her fingers into the opening to access the next towel. This is unsatisfactory from a hygienic point of view.

An alternative solution is shown in U.S. Pat. No. 4,811,878, where a funnel-shaped guide is provided directly under a stack of towels for guiding and presenting consecutive towels to a user. The guide extends below the dispenser and is shaped to direct a leading edge of a towel to the user. A problem with this arrangement is that the funnel shaped part of the guide causes the stack to sag in the middle and may cause the first towel to wedge and tear. The design of the guide will make it very difficult for the user to reach the next towel, as the guide will be blocked by the first towel. A further problem is that the positioning of the part of the guide means used for presenting the leading edge of the towel is likely to cause the guide to be grabbed by a large number of users. Again, this is unsatisfactory from a hygienic point of view.

In order to solve this problem it may be necessary to allow a leading edge of the towel to extend out of the dispenser. Firstly, this is not desirable from a hygienic point of view. Secondly, a user may be able to grab and pull the leading edge of the towel before the mechanism has started to feed the stack. If the stack is subjected to a pulling force prior to or during the feeding operation, then the operation may be disrupted by the stack tearing in the wrong position or wedging a feeding mechanism, causing the dispenser to malfunction.

DISCLOSURE OF INVENTION

The invention aims to solve the above problems by providing an improved dispenser as defined by the appended claims.

In the subsequent text, terms such as inner, outer, front and rear are used to define relative positions of components making up the dispenser, as viewed by a person using the invention.

According to one embodiment of the invention, these objects are achieved by means of a paper towel dispenser comprising a housing for holding a stack of interfolded towels, said housing comprising a front wall; a rear wall, two outer side walls, an upper wall and a support surface for supporting the stack of towels inside the dispenser. The stack of towels may be located adjacent and parallel to at least the front wall, wherein the folds in said towels are arranged parallel to at least the front wall. The front wall extends a predetermined distance below the support surface and a dispensing opening is located between the inner surface of the front wall and an edge of the support surface facing the front wall. The dispensing opening may be located below a lower front edge of the stack of towels. At least one guide means may be arranged to support a leading panel of a first towel in a presentation position behind and adjacent the front wall. A leading edge of said leading panel of a first towel may be arranged parallel to the lower edge of the front wall along the entire length of the towel. In this context, the length of the towel is measured parallel to the front wall and the width parallel to a side wall.

The at least one guide means may comprise a first section and a second section, where the first section comprises at least one portion arranged spaced a predetermined distance away from the front wall and the second section is arranged adjacent to and substantially parallel with the front wall. When a user grips the leading panel and withdraws a first towel, the leading edge of a subsequent towel will be caused to curl, due to the friction between the interfolded layers. In order to allow the leading edge of a subsequent towel to uncurl towards the presentation position, the first section of the guide means comprises an enlarged portion that is spaced away from the inner surface of the front wall. This enlarged portion allows the leading panel of a subsequent towel to uncurl and drop downwards into the presentation position under its own weight. This operation will be described in further detail below.

The first section of the guide means comprises an upper portion arranged to extend downwards from the support surface from a position adjacent the dispensing opening. The vertical extension of the first portion may be equal to the thickness of the support surface, or may continue a short distance below the support surface. The first section further comprises an enlarged lower portion having a predetermined curvature with its apex directed away from the front wall. The curvature of the lower portion may be substantially semicircular, or be shaped as a sine curve, a hyperbolic curve or similar.

Alternatively, the first section may be arranged to extend downwards from a position spaced a predetermined distance from the dispensing opening and the front wall toward the front wall. The first section may be attached to either or both of the side walls or the lower side of the support surface. According to a first example, the first section may be arranged to extend downwards at an angle towards the second section. According to a second example, the first section may be arranged to extend downwards with a predetermined curvature towards the second section.

Preferably, the width of the dispensing opening may be equal to or greater than the width of the stack of towels. This arrangement prevents the side edges of a towel to be withdrawn from catching in the dispensing opening. Hence, consecutive towels may be prevented from bunching and/or tearing during withdrawal, which could otherwise interrupt of the dispensing process. The depth of the dispenser opening, that is the horizontal distance between the inner surface of the front wall and the front end of the support surface, is selected depending on the type and/or quality of towel to be dispensed. Along the initial part of the first section of the guide means the depth of the dispenser opening must be sufficient to allow a curled leading panel of a towel to pass into the enlarged portion of the guide means. For instance, a comparatively thick, high grade towel will require a relatively deep dispensing opening and more space to uncurl as compared to a thinner low grade towel.

The second section is arranged adjacent to and substantially parallel with the front wall in order to support the leading panel of a towel in the presentation position. The horizontal distance between the inner surface of the front wall and the facing surface of the second section may be equal to or less than the depth of the dispenser opening.

In order to facilitate dispensing, the leading panel of a first towel is preferably arranged visible through a cut-out in the lower edge of the front wall. According to the invention, the at least one guide means is discontinued adjacent the cut-out, so that the guide means may be concealed behind the lower edge of the front wall. The vertical extension of such a cut-out may be selected less than or equal to the vertical extension of the front wall below the support surface. This arrangement allows the hand of a user to be automatically guided towards the visible portion of the first towel. In this way the dispenser will be kept clean and hygienic, as the user will have no incentive to touch the dispenser adjacent the cut-out and accidentally come into contact with the guide means. The relatively low front wall will also cover the subsequent towel and the stack itself and assists in keeping the dispenser clean and hygienic.

According to a first example, the dispenser may be provided with a central cut-out in the lower edge of the front wall. Depending on design parameters for the dispenser, the cut-out could also be positioned off-set relative to a central vertical plane through the front wall of the dispenser. In these cases, the guide means is preferably arranged on both sides of the cut-out. According to a second example, the dispenser may be provided with a cut-out arranged adjacent a corner of the front wall, terminating at an adjacent side wall. In this case, a single guide means could be arranged to extend from the opposite side wall, parallel with the front wall and terminate adjacent the cut-out. In order to access a leading panel of a new stack of towels, a further recess or cut-out may be provided in at least a front section of the support surface behind the cut-out in the lower edge of the front wall. The width of such a further cut-out may be equal to or less than the available distance between or space behind the cut-out in the lower edge of the front wall. The depth of the further cut-out may be selected to extend a distance from a third up to the entire width of the support surface. Preferably, the further cut-out should end a predetermined distance from the side wall, in order to provide sufficient support for the stack of towels at both ends and to prevent an end of said stack to sag.

As stated above it is desirable to keep the first towel concealed behind the front wall and only expose a portion of the towel through the said cut-out. In order to achieve this, the front wall is preferably arranged to extend a distance below the support surface corresponding to the width of one folded panel of an interfolded towel.

A further advantage of the invention is that the presented first panel of each consecutive interfolded towel will be located in the same position relative to the cut-out in the front wall. In this way, the entire front wall of the dispenser, including the area of the cut-out, may be used for informative text or pictorial design. This will allow a logotype, informative text or a design pattern to be continued into the cut-out section of the front wall. Alternatively, a printed indicator can be provided on the visible portion of the leading first panel. The indicator may be a marker appearing to be displaced across the cut-out as consecutive towels are dispensed, where the current position of the marker is an indication of the remaining number of towels. Alternatively, a coloured section printed on the visible panel may appear to change position or colour as the stack of towels is gradually depleted. Such a coloured section may be integrated with a design on the front wall of the dispenser.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1:
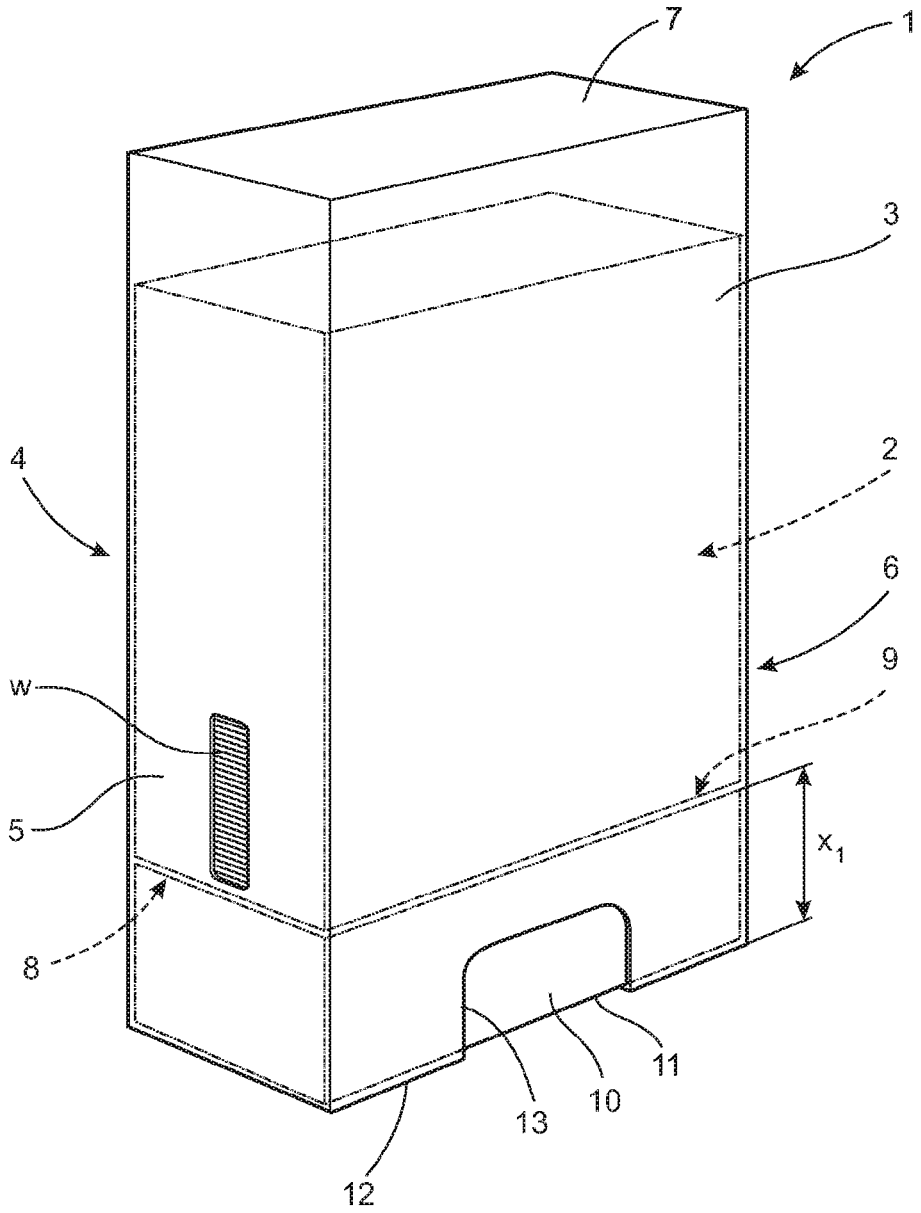
FIG. 1 shows a schematic perspective view of a dispenser according to the invention.

FIG. 1 shows a schematic perspective view of a paper towel dispenser according to the invention. The figure shows a dispenser comprising a housing 1 for holding a stack of interfolded towels 2 (indicated with dash-dotted lines), said housing 1 comprising an outer front wall 3; a rear wall 4, two outer side walls 5, 6, an upper wall 7 and a horizontal support surface 8 (indicated with dash-dotted lines) for the stack of towels 2 inside the housing. In FIG. 1 the housing 1 is drawn partially transparent in order to show the internal structure of the dispenser. The front wall 3 extends a predetermined distance $x_1$ below the support surface 8, and a dispensing opening 9 is located between the front wall 3 and a front edge of the support surface 8 (see FIG. 2). A pair of guide means (see FIGS. 2 & 6) are arranged to support a leading panel 10 of a first towel located adjacent the front wall 3 and a leading edge 11 of said leading panel 10 is arranged parallel to a lower edge 12 of the front wall 3. A portion of the leading panel 10 of a first towel is visible through a cut-out 13 in the lower edge 12 of the front wall 3, allowing a user to grip and withdraw the first towel. Access to the stack of towels 2 from below is provided with an additional cut-out in the front portion of the support surface. This additional cut-out can be located above the cut-out 13 in the lower edge 12 of the front wall 3. The housing 1 can be completely or partially opaque and is provided with a transparent indicator window W for allowing inspection of the filling level of the stack of towels.

The presented leading panel 10 of each consecutive interfolded towel will be located in the same position relative to the cut-out 13 in the front wall 3. This allows the entire front wall 3 of the dispenser, including the area of the cutout 13, to be used for informative text or pictorial design. For instance, a logotype, informative text or a design pattern can be continued from the front wall 3 into the cut-out 13 in the front wall. Alternatively, a printed indicator can be provided on the visible portion of the leading first panel. According to a first example, the indicator may be a marker appearing to be displaced across a horizontal or vertical limiting edge of the cut-out 13 as consecutive towels are dispensed, where the current position of the marker is an indication of the remaining number of towels is the dispenser. Alternatively, a coloured section of the visible panel can be printed appearing to change position or colour as the stack of towels is gradually depleted.

Figure 2:
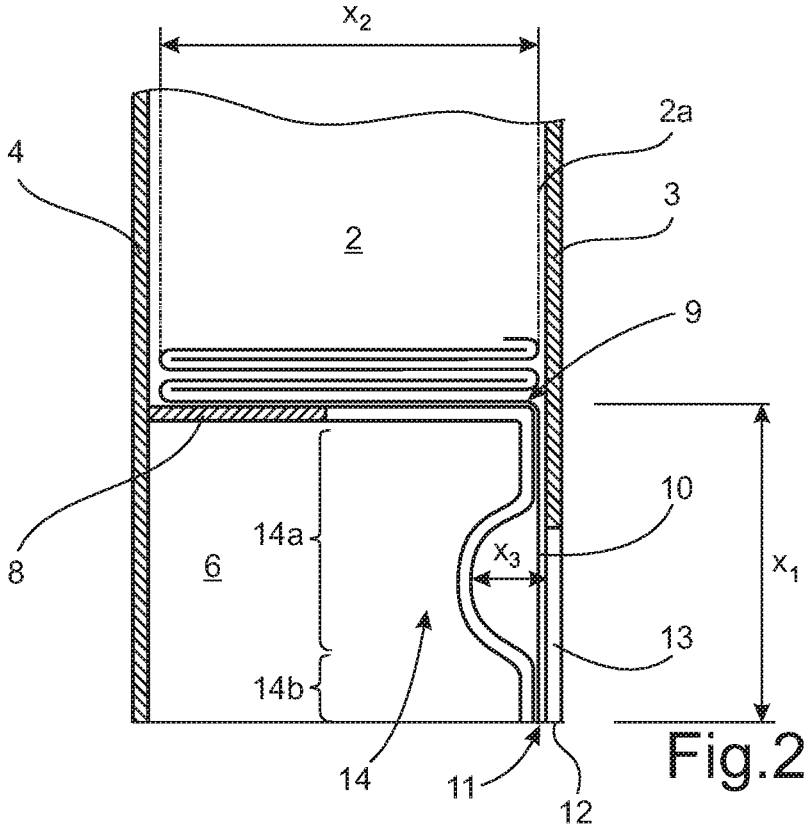
FIG. 2 shows a schematic cross-sectional view of a lower portion of the dispenser in FIG. 1.

FIG. 2 shows a schematic cross-sectional view in a central vertical plane taken at right angles to the front wall, at the lower portion of the dispenser in FIG. 1. In FIG. 2 the stack of towels 2 is located on the support surface 8 and a front edge 2*a* of said stack is placed above the dispensing opening 9. The leading panel 10 of the first towel located adjacent the front wall 3 and is supported in this presentation position by a guide means 14. The leading edge 11 of said leading panel 10 is arranged parallel to the lower edge 12 of the front wall 3. A portion of the leading panel 10 of a first towel is visible through the cut-out 13 in the lower edge 12 of the front wall 3. As indicated in FIG. 1, the front wall 3 extends a predetermined distance $x_1$ below the level of the support surface 8. This predetermined distance $x_1$ preferably corresponds to the width $x_2$ of one folded panel of an interfolded towel, as shown in FIG. 2. In order to access a leading panel of a new stack of towels, a cut-out is provided in a front section of the support surface 8 behind the cut-out 13 in the lower edge 12 of the front wall 3.

The guide means 14 comprises a first section 14*a* and a second section 14*b*. The first section 14*a* comprises an enlarged portion arranged spaced a predetermined distance away from the front wall in order to allow the leading edge of a subsequent towel to uncurl towards the presentation position. In FIG. 2, the cross-section through the first section 14*a* has a substantially sinusoidal shape. This function will be described in further detail in connection with the FIGS. 8A-E below. The second section 14*b* is arranged adjacent to and parallel with the front wall 3, in order to support the leading panel 10 in the presentation position. This arrangement ensures that the first panel of each consecutive towel is held flat and is presented to the user in the same way each time.

Figure 3:
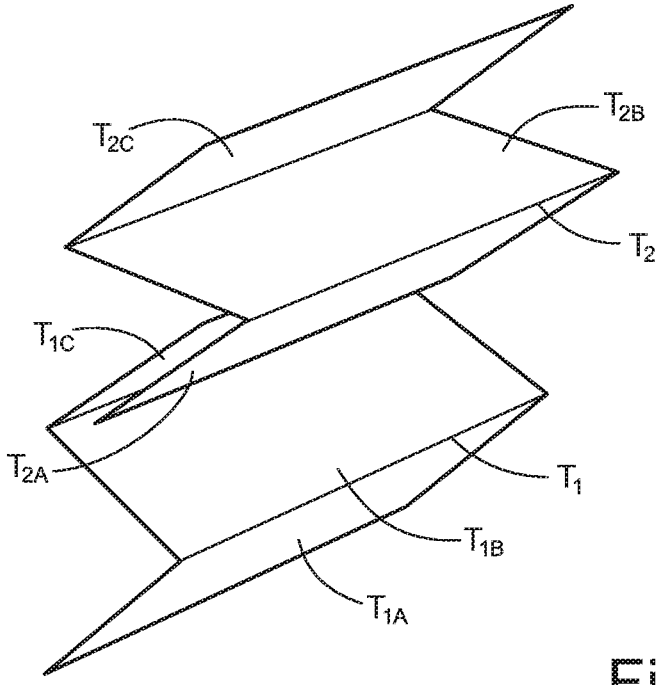
FIG. 3 shows a schematic representation view of two consecutive, interfolded towels used in a dispenser according to the invention.

FIG. 3 shows a schematic representation of two consecutive, interfolded towels $T_1$, $T_2$. Each towel comprises three panels $T_{1A}$-$T_{1C}$, $T_{2A}$-$T_{2C}$, where the trailing panel $T_{1C}$ of a first towel $T_1$ is interfolded with the leading panel $T_{2A}$ of a subsequent towel $T_2$. In the presentation position, the leading panel of $T_{1A}$, $T_{2A}$ would be located visible through the cut-out 13 in the lower edge 12 of the front wall 3 (see panel 10 in FIG. 2). FIG. 3 shows the towels $T_1$, $T_2$ arranged in a schematic Z-shape for clarity. When placed in a stack, each towel will be substantially flat, as schematically indicated in FIG. 2. FIG. 3 shows a preferred interfolding of the towels, but alternative folding arrangements are possible within the scope of the invention.

Figure 4:
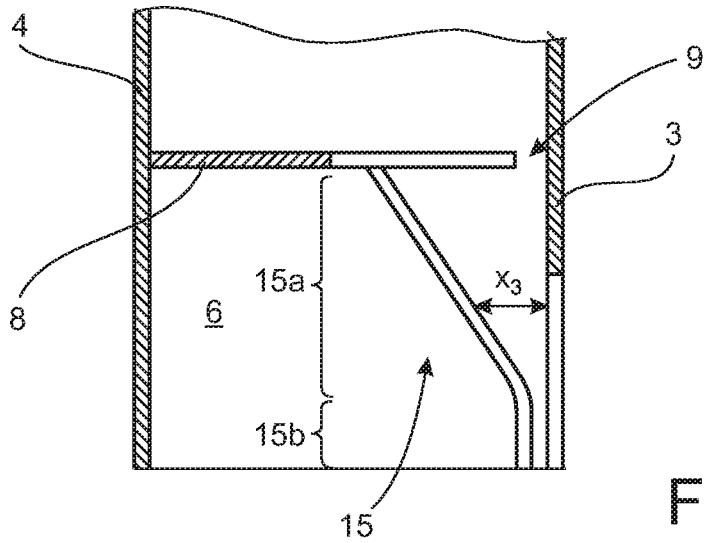
FIG. 4 shows a first alternative cross-sectional shape used for a guide means according to the invention.
Figure 5:
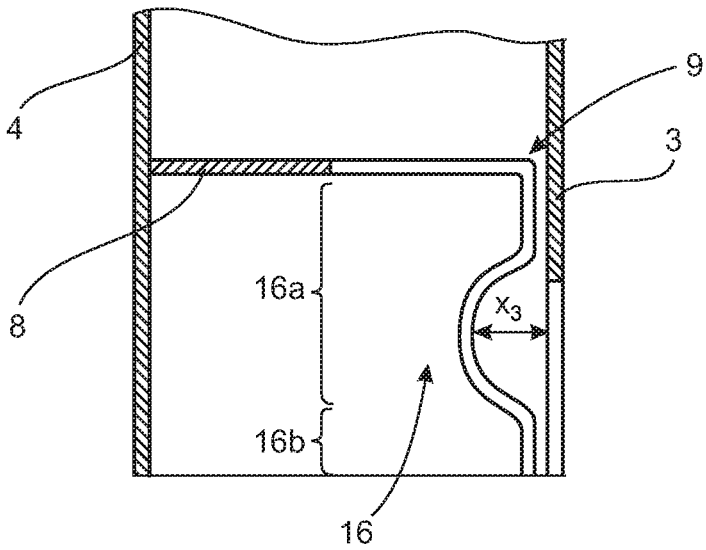
FIG. 5 shows a second alternative cross-sectional shape used for a guide means according to the invention.

FIGS. 4 and 5 show alternative cross-sectional shapes that can be used for the first section 15*a*, 16*a* of the guide means 15, 16. In FIG. 4, the cross-section through the first section 15*a* has a curved shape extending from a position remote from the dispensing opening 9, downwards to merge with the straight second section 15*b*. FIG. 5, the cross-section through the first section 16*a* extends downwards from a position adjacent the dispensing opening 9 and then assumes a semi-circular shape, before merging with the straight second section 16*b*.

The first section of the guide means 15*a*, 16*a* comprises a portion arranged spaced a minimum predetermined distance $x_3$ away from the front wall 3 in order to allow the leading edge of a subsequent towel to uncurl towards the presentation position. This minimum predetermined distance $x_3$ is preferably at least a third of the width $x_2$ of a folded towel placed on the support surface in the dispenser. The vertical extension of this widened portion is preferably between a third and two thirds of the extension x1 of the front wall as indicated in FIG. 2. In the example shown in FIG. 4, the distance between the first section 15*a* of the guide means 15 and the front wall 3 is gradually reduced in the dispensing direction. The location of the minimum predetermined distance $x_3$ is a third of the length of the extension x1 of the front wall 3, measured from the support surface 8. In the example shown in FIG. 5, the distance between the first section 16*a* of the guide means 16 and the front wall 3 has a maximum width at the apex of the semi-circular portion of the guide means 16. This maximum width is equal to the minimum predetermined distance $x_3$. The location of the minimum predetermined distance $x_3$ is half the length of the extension $x_1$ of the front wall 3, measured from the support surface 8.

Preferably the minimum predetermined distance $x_3$ is located at or above a third and half of the length of the extension $x_1$ of the front wall, measured from the support surface 8.

Figure 6:
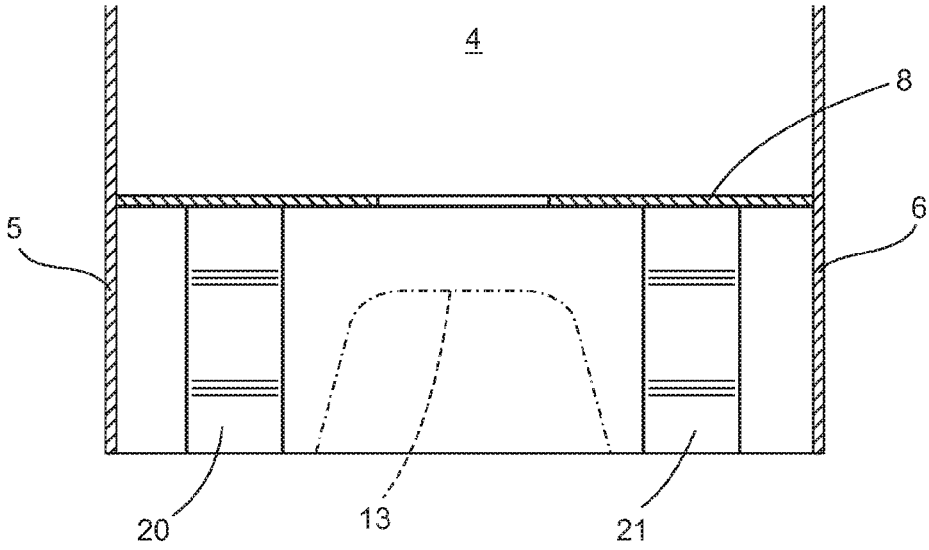
FIG. 6 shows a front view of a lower section of the dispenser in FIG. 1, provided with a first alternative guide means.

FIG. 6 shows a front view of a lower section of the dispenser in FIG. 1, with the front wall 3 removed to expose the guide means. In this figure the cut-out 13 (indicated in dash-dotted lines) is arranged in a central position of the lower edge of the front wall (not shown). In this embodiment, the guide means 20, 21 comprises two individual supports located on either side of the cut-out 13. In this way the guide means 20, 21 will hold the leading panel of a first towel flat against the inner surface of the front wall. The visible portion of the leading panel can be gripped and the first towel withdrawn, without the user coming into contact with any part of the guide means 20, 21.

Figure 7:
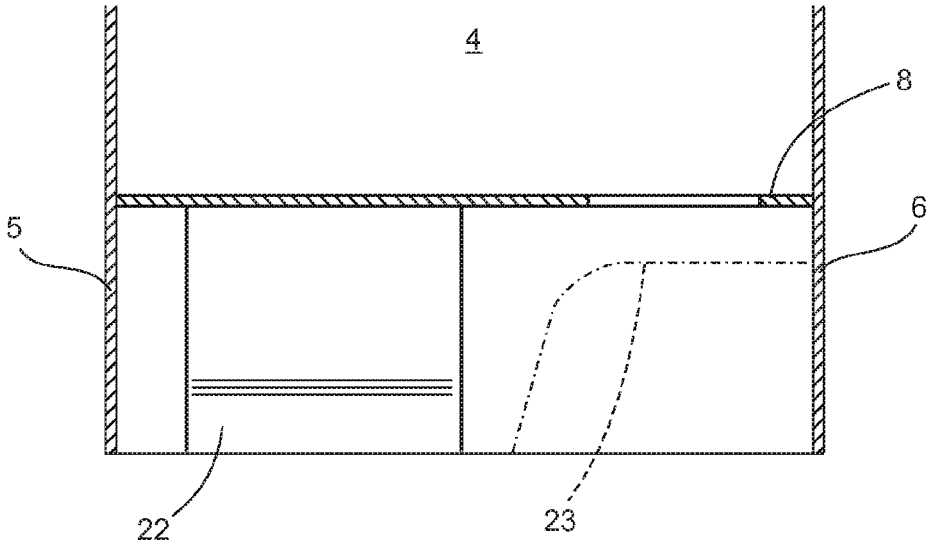
FIG. 7 shows a front view of a lower section of the dispenser in FIG. 1, provided with a second alternative guide means.

FIG. 7 shows a front view of a lower section of a dispenser with a cut-out 23 located in an alternative position. In this figure the cut-out 23 (indicated in dash-dotted lines) is arranged adjacent a corner of the dispenser in the lower edge of the front wall (not shown), terminating at an adjacent side wall 6. In this embodiment, the guide means 22 comprises a single support arranged to extend from the opposite side wall 5, parallel with the front wall and terminate adjacent the cut-out 23. In this way the guide means 22 will hold the leading panel of a first towel flat against the inner surface of the front wall. Similarly, the visible corner of the leading panel can be gripped and the first towel withdrawn, without the user coming into contact with any part of the guide means 22.

FIGS. 8A-E shows a sequence of events occurring while a towel is being dispensed by pulling the leading edge of a first towel from the stack of towels.

Figure 8A:
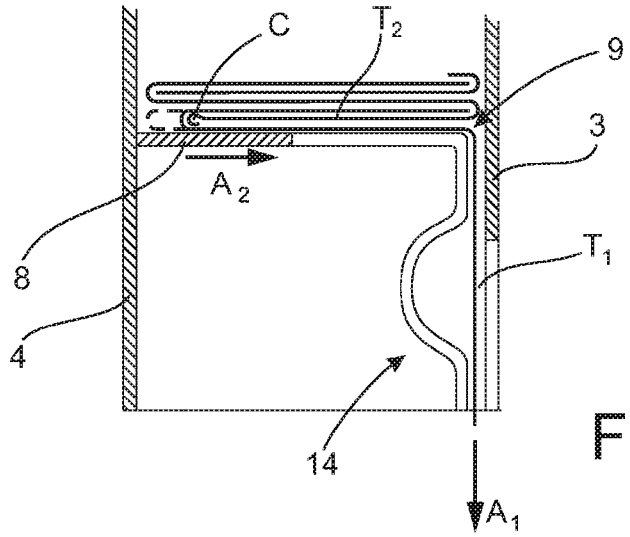
FIGS. 8A/E shows a sequence of events occurring while a towel is being dispensed from the dispenser in FIG. 1.
Figure 8B:
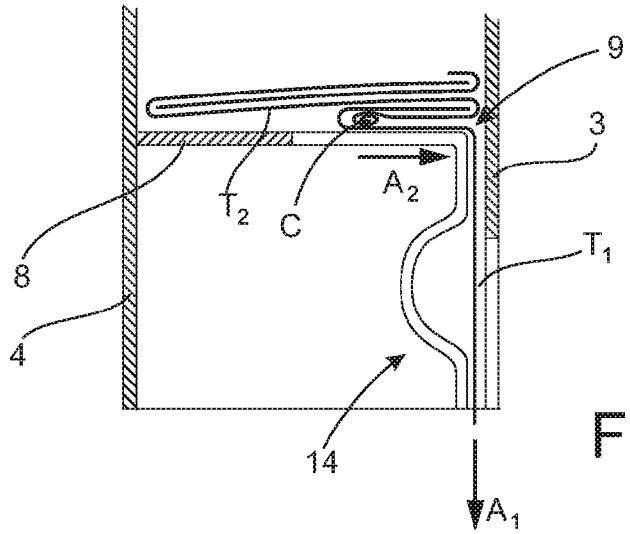

The user will grip and pull the leading panel of a first towel $T_1$ (see FIG. 3) downwards in the general direction of the arrow $A_1$. As the first panel $T_{1A}$ is withdrawn, the second and third panels $T_{1B}$, $T_{1C}$ of the first towel $T_1$ will be displaced towards the dispensing opening 9 along the support surface 8 in the direction of the arrow $A_2$. This displacement is indicated by dashed lines in FIG. 8A. The simultaneous displacement of the second and third panels $T_{1B}$, $T_{1C}$ of the first towel $T_1$ will cause the first panel $T_{2A}$ of the subsequent second towel $T_2$ to form a curl C. The formation of this curl C is caused by friction forces between the moving second and third panels $T_{1B}$, $T_{1C}$ of the first towel $T_1$ and the stationary first panel $T_{2A}$ of the subsequent second towel $T_2$. As indicated in FIG. 8B, the curl C will continue to form as long as the first towel $T_1$ is located on the support surface 8.

Figure 8C:
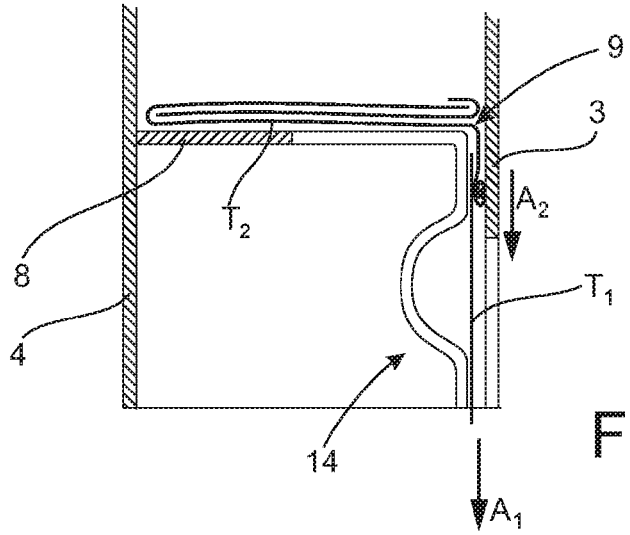
Figure 8D:
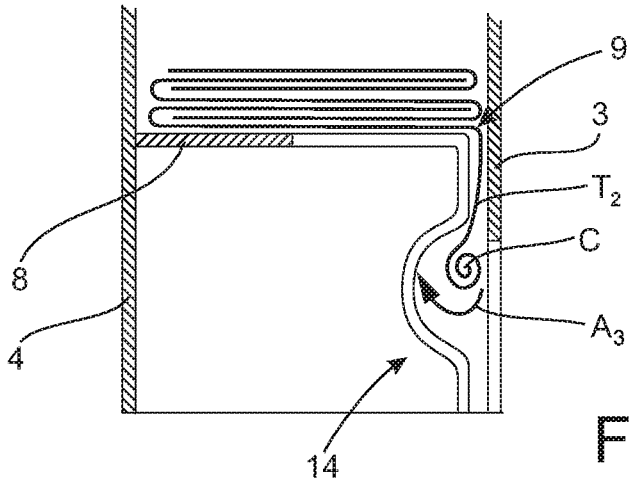
Figure 8E:
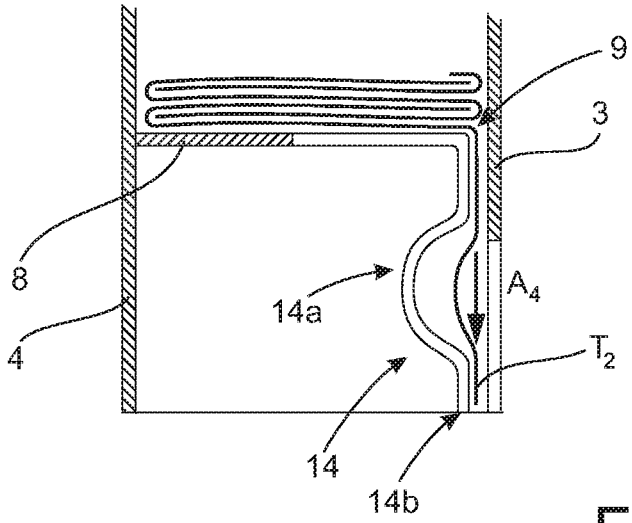
Figure 9:
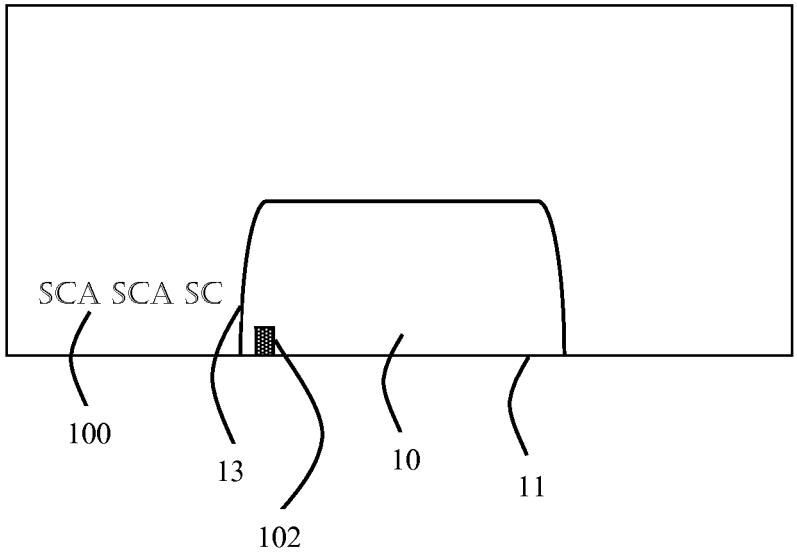
FIG. 9 is a view of the lower portion of the front of the dispenser of the present invention.

When the first towel $T_1$ passes through the dispensing opening 9, as shown in FIG. 8C, the curled first panel $T_{2A}$ of the second towel will be pulled through the dispensing opening by the third panel $T_{1C}$ of the first towel $T_1$ as it is drawn past the front wall 3 and is removed from the dispenser. The curled first panel $T_{2A}$ of the second towel will drop down into the enlarged portion of the first section 14*a* of the guide means 14. When reaching this enlarged portion, the first panel $T_{2A}$ will have sufficient space to uncurl, as indicated by the arrow $A_3$ in FIG. 8D. Once uncurled, the leading edge of the first panel $T_{2A}$ will fall downwards under its own weight and be guided into the presentation position by the section 14*a* of the guide means 14 and the front wall 3, as indicated by the arrow $A_4$ in FIG. 8E. The second towel $T_2$ is then ready to be dispensed, whereby the sequence indicated in FIGS. 8A-E is repeated.

The width of the dispensing opening is equal to or greater than the width of the stack of towels. The depth of the dispenser opening, that is the horizontal distance between the inner surface of the front wall 3 and the front end of the support surface 8, is selected depending on the type and/or quality of towel to be dispensed. Along the initial part of the first section of the guide means the depth of the dispenser opening must be sufficient to allow a curled leading panel of a towel to pass into the enlarged portion of the guide means. For instance, a comparatively thick, high grade towel will require a relatively deep dispensing opening and more space to uncurl as compared to a thinner low grade towel.

The invention is not limited to the above examples, but may be varied freely within the scope of the appended claims.

The invention claimed is:

1. A paper towel dispenser, comprising:

a housing for holding a stack of interfolded towels; said housing comprising a front wall, a rear wall, two outer side walls, an upper wall and a support surface for the stack of towels; said stack of towels being located adjacent and parallel to at least the front wall; wherein the front wall extends a predetermined distance below the support surface, a dispensing opening is located between the front wall and the support surface, and at least one guide is arranged to support a leading panel of a first towel adjacent the front wall and a leading edge of said leading panel parallel to a lower edge of the front wall, wherein the guide comprises a first section and a second section; the first section comprising an upper portion and a lower portion arranged spaced a predetermined distance away from the front wall, and the second section being arranged adjacent to and parallel with the front wall, and wherein the upper portion is arranged to extend downwards from the support surface from a position adjacent the dispensing opening, and the lower portion has a predetermined curvature with an apex directed away from the front wall.

2. The paper towel dispenser according to claim 1, wherein the width of the dispensing opening is equal to or greater than the width of the stack of towels.

3. The paper towel dispenser according to claim 1, wherein the leading panel of a first towel is visible through a cut-out in the lower edge of the front wall.

4. The paper towel dispenser according to claim 3, wherein the guide is discontinued adjacent the cut-out.

5. The paper towel dispenser according to claim 3, wherein the dispenser is provided with a central cut-out in the front wall.

6. The paper towel dispenser according to claim 5, wherein the guide is arranged on both sides of the cut-out.

7. The paper towel dispenser according to claim 3, wherein the dispenser is provided with a cut-out arranged adjacent a corner of the front wall.

8. The paper towel dispenser according to claim 1, wherein the front wall extends a distance ($x_1$) below the support surface corresponding to the width ($x_2$) of one folded panel of an interfolded towel.

9. The paper towel dispenser according to claim 1, wherein the leading panel of each consecutive interfolded towel is located in the same position relative to a cut-out in the front wall.

10. The paper towel dispenser according to claim 1, wherein a printed indicator is provided on the visible portion of each leading first panel, where the current position of the printed indicator is an indication of the remaining number of towels is the dispenser.

11. A paper towel dispenser, comprising:

a housing for holding a stack of interfolded towels; said housing comprising a front wall, a rear wall, two outer side walls, an upper wall and a support surface for the stack of towels; said stack of towels being located adjacent and parallel to at least the front wall; wherein the front wall extends a predetermined distance below the support surface, a dispensing opening is located between the front wall and the support surface and at least one guide is arranged to support a leading panel of a first towel adjacent the front wall and a leading edge of said leading panel parallel to a lower edge of the front wall, wherein the guide comprises a first section and a second section; the first section comprising at least one portion arranged spaced a predetermined distance away from the front wall, and the second section being arranged adjacent to and parallel with the front wall, wherein the first section is arranged to extend downwards from a position spaced a predetermined distance from the dispensing opening and the front wall toward the front wall, and wherein the first section is arranged to extend downwards with a predetermined curvature towards the second section.

12. A paper towel dispenser, comprising:

a front wall;

a central cut-out in the front wall;

a rear wall;

two outer side walls;

an upper wall;

a support surface configured for supporting a stack of towels, said stack of towels being located adjacent and parallel to at least the front wall, the central cut-out defining at least a portion of a dispensing opening located between the front wall and the support surface, and the front wall extends a predetermined distance below the support surface; and at least one guide arranged to support a leading panel of a first towel adjacent the front wall and a leading edge of said leading panel parallel to a lower edge of the front wall, wherein the guide comprises a first section and a second section, the first section comprising at least one portion arranged spaced a predetermined distance away from the front wall, and the second section being arranged adjacent to and parallel with the front wall, and wherein the first section comprises an upper portion arranged to extend downwards from the support surface from a position adjacent the dispensing opening, and a lower portion having a predetermined curvature with an apex directed away from the front wall.

* * * * *